US009649606B2

(12) United States Patent
Ruff

(10) Patent No.: US 9,649,606 B2
(45) Date of Patent: May 16, 2017

(54) METHOD AND APPARATUS FOR AERATING LIQUID

(76) Inventor: Jason Ruff, Birmingham, MI (US)

( * ) Notice: Subject to any disclaimer, the term of this patent is extended or adjusted under 35 U.S.C. 154(b) by 728 days.

(21) Appl. No.: 13/367,330

(22) Filed: Feb. 6, 2012

(65) Prior Publication Data

US 2013/0201782 A1 Aug. 8, 2013

(51) Int. Cl.
*B01F 13/00* (2006.01)
*A47G 23/02* (2006.01)
*B01F 15/00* (2006.01)

(52) U.S. Cl.
CPC ..... *B01F 13/0022* (2013.01); *A47G 23/0241* (2013.01); *B01F 15/00512* (2013.01); *B01F 15/00876* (2013.01); *B01F 2215/0072* (2013.01)

(58) Field of Classification Search
CPC .... B65D 2501/0036; B65D 2501/0081; B01F 13/0022
USPC ..... 215/382, 386, 375; 220/501, 669; 366/130
See application file for complete search history.

(56) References Cited

U.S. PATENT DOCUMENTS 34,783 A * 3/1862 Schies ..... 454/291
97,922 A * 12/1869 Houghton ..... B65D 1/0246 215/286
D20,027 S * 7/1890 Bentley ..... D7/317
579,867 A * 3/1897 Fenn ..... 215/386
D59,309 S * 10/1921 Vidulich ..... D7/317
D211,978 S * 8/1968 Douglas ..... D7/300
3,598,270 A * 8/1971 Adomaitis ..... B65D 1/0284 215/375
3,871,541 A * 3/1975 Adomaitis ..... B65D 1/0284 215/375
3,935,955 A * 2/1976 Das ..... B65D 1/0284 215/375
4,155,474 A * 5/1979 Bizzarri ..... 215/365
4,243,162 A * 1/1981 Klygis ..... 222/530
4,368,825 A * 1/1983 Motill ..... B65D 1/0284 215/375
D269,066 S * 5/1983 Gaunt ..... 215/375
D269,158 S * 5/1983 Gaunt ..... 215/375
4,867,323 A * 9/1989 Powers ..... B65D 1/0284 215/375
D305,983 S * 2/1990 Daucourt ..... D7/300
D309,101 S * 7/1990 Gardere ..... D7/300
5,024,340 A * 6/1991 Alberghini ..... B65D 1/0284 215/375
5,133,468 A * 7/1992 Brunson ..... B65D 1/0284 215/375
5,205,434 A * 4/1993 Brunson ..... B65D 1/0284 215/375
D338,834 S * 8/1993 Paju ..... D9/545
5,385,250 A * 1/1995 Pasquale ..... 215/374
D372,427 S * 8/1996 Jago ..... D9/500
5,579,962 A 12/1996 Chen
5,713,263 A 2/1998 Burks, III
5,735,421 A * 4/1998 Deemer et al. ..... 215/382
5,740,934 A * 4/1998 Brady ..... 215/381
(Continued)

*Primary Examiner* — Abbas Rashid
(74) *Attorney, Agent, or Firm* — Diana D. Brehob

(57) ABSTRACT

A liquid aeration apparatus is a vessel with a neck and an opening that is interconnected to a body. The opening receives a quantity of liquid that is thinned as the liquid is transferred from the neck to the body. The liquid is then collected in the body of the vessel. The body includes at least one tripping mechanism that induces turbulence to the liquid.

14 Claims, 4 Drawing Sheets

(56) References Cited

U.S. PATENT DOCUMENTS

| | | | | |
|---|---|---|---|---|
| 5,803,290 | A * | 9/1998 | Bongiorno | B65D 23/102 215/375 |
| 5,906,286 | A * | 5/1999 | Matsuno | B29C 49/12 215/373 |
| 6,145,681 | A * | 11/2000 | Chimetto et al. | 215/384 |
| 6,149,024 | A * | 11/2000 | Deemer et al. | 215/382 |
| 6,332,706 | B1 | 12/2001 | Hall | |
| D514,368 | S | 2/2006 | Rocha | |
| D602,359 | S * | 10/2009 | Eisen | D9/500 |
| 7,686,178 | B2 * | 3/2010 | Grant et al. | 215/384 |
| 8,141,733 | B2 * | 3/2012 | Matsuoka | 215/383 |
| D673,415 | S * | 1/2013 | Genuardi | D7/300.1 |
| 8,993,021 | B2 * | 3/2015 | Nishibe | B65D 1/165 215/375 |
| 2007/0108156 | A1 * | 5/2007 | Durand | B65D 1/0223 215/375 |
| 2010/0025867 | A1 | 2/2010 | Benton et al. | |
| 2010/0058933 | A1 | 3/2010 | Cheng | |
| 2010/0163515 | A1 * | 7/2010 | Nemoto | B65D 1/0223 215/382 |

* cited by examiner

METHOD AND APPARATUS FOR AERATING LIQUID

TECHNICAL FIELD

This disclosure is related to aeration of liquids, and particularly to liquids that require aeration prior to drinking.

BACKGROUND

The statements in this section merely provide background information related to the present disclosure and may not constitute prior art. Certain liquids meant for consumption can benefit from aeration or exposure to air. Aeration is known to aid in bringing out the full flavors or body of the liquid as well as to bring out a more aromatic scent to be more pleasing. Aeration is particularly used in aiding the drinkability of beverages that contain alcohol, such as wines and spirits. Aerating the beverage typically comprises opening the container holding the beverage and pouring the liquid into a separate vessel. The vessel typically has a shape that allows for a large surface area of liquid to be exposed to the air and is often referred to as a decanter. The vessel typically has a neck that remains open to the air allowing for the aeration process to occur over time. The vessel may include a stopper or plug which may be inserted into the neck to stop the aeration process from further occurring.

Aerating a liquid with the current vessel technology typically takes a substantial amount of time. The time required can be 15 minutes to over two hours depending on the type of beverage, age of beverage, and desired or optimal characteristics for the beverage, e.g., when the beverage achieves the desired scent or flavor characteristics. The time delay prevents one from enjoying the beverage with the desired or optimal characteristics when several bottles of beverages are to be drunk in an evening or an impromptu serving is desired with a beverage that benefits from aerating.

Additionally, intermediary aeration devices exist, e.g., devices that create a venturi effect or separation of the liquid, that may be used as beverages are poured between an original container to a secondary vessel, i.e., an intermediary device between the storing container and the serving vessel or container. The intermediary aeration devices are limited in effectiveness as they only aerate the beverage a defined amount, as originally intended by the manufacturer. Should the particular beverage require more or less aeration, the intermediary aeration device is not capable of producing the required differential amount. Further, the intermediary aeration devices can be difficult to operate as the liquid can back up and overflow the intermediary aeration device or a slight movement in either the device or the original container can cause a spill.

SUMMARY

A liquid aeration apparatus is a vessel with a neck and an opening that is interconnected to a body. The opening receives a quantity of liquid that is thinned as the liquid is transferred from the neck to the body. The liquid is then collected in the body of the vessel.

BRIEF DESCRIPTION OF THE DRAWINGS

One or more embodiments will now be described, by way of example, with reference to the accompanying drawings, in which.

DETAILED DESCRIPTION

Figure 1:
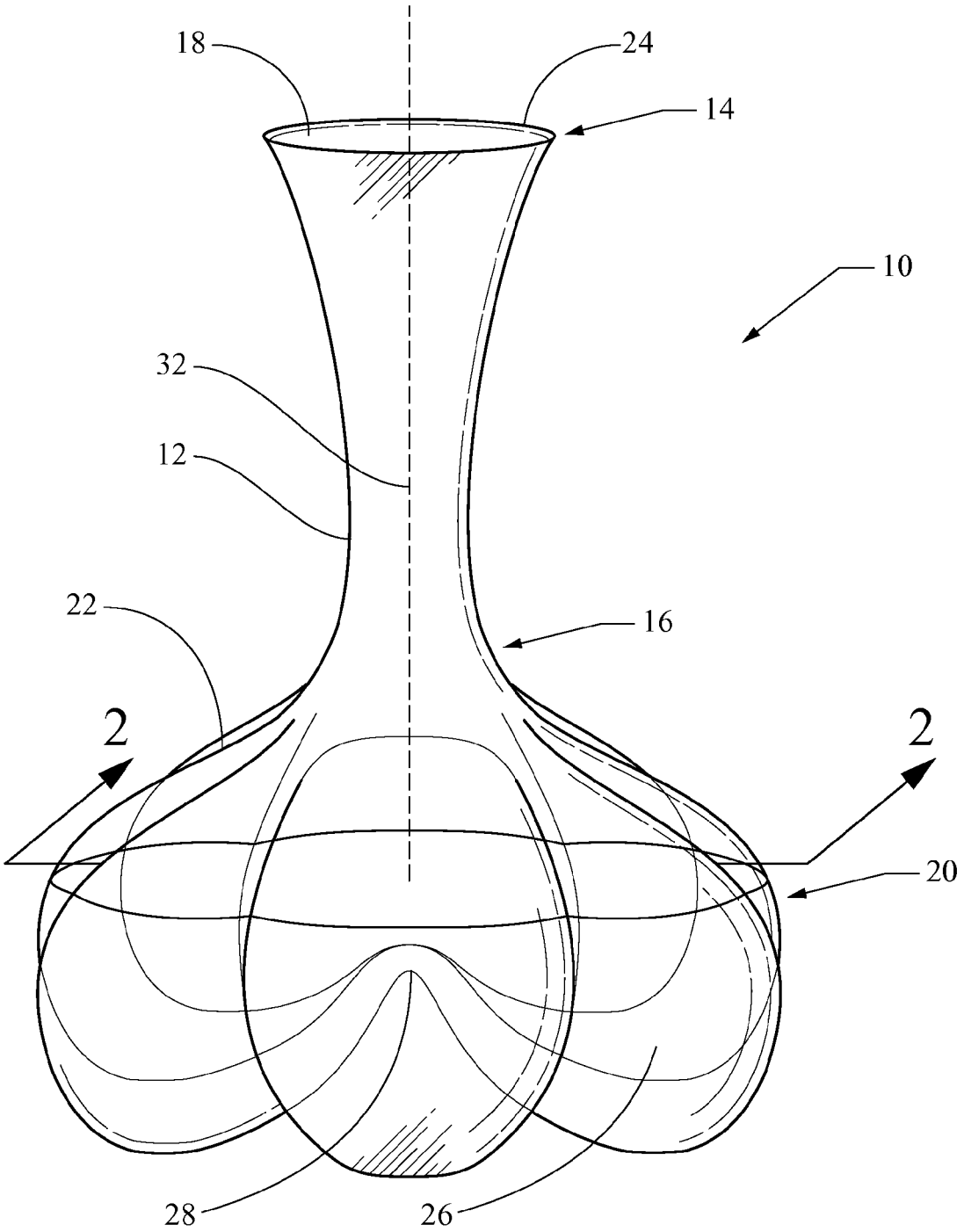
FIG. 1 schematically illustrates a vessel capable of aerating and containing a liquid, in accordance with the present disclosure.

Referring now to the drawings, wherein the showings are for the purpose of illustrating certain exemplary embodiments only and not for the purpose of limiting the same, FIG. 1 schematically illustrates a vessel 10 capable of aerating and containing a liquid. The vessel 10 includes a neck 12 that has a first end 14 and a distal second end 16. The first end 14 defines an opening 18 for allowing liquid and gas to pass into and out of the vessel 10. The opening 18 can be of any shape, e.g., oval or rectangular, but is preferably round. The neck 12 decreases in size between the opening 18 and the second end 16 to spread the liquid evenly around the neck 12 as the liquid is received into the vessel 10. The neck 12 spreading the liquid around can create a swirling or venturi effect or can create a smooth flow of liquid over an inner surface of the neck 12. The second end 16 interconnects the neck 12 with a body 20 through a shoulder 22. The body 20 contains the liquid within the vessel 10 and supports the vessel 10 when placed on a flat surface. The vessel 10 will be described as generally symmetrical about an axis 32 located at or near the center of the vessel 10 for convenience and clarity however it will be apparent that various offsets can be made without varying from the scope of this disclosure, e.g., the neck 12 can extend on an angle from the body 20 and can be directly offset from the axis 32.

The first end 14 of the neck 12 is wider than the second end 16 to facilitate pouring the liquid into and out of the vessel 10. It is understood that the neck 12 can be straight or the second end 16 can be wider than the first end 14 without varying from the scope of the disclosure. The first end 14 has an edge 24 that is thinner than the remainder of the vessel 10 to facilitate a drip free pour of the liquid out of the vessel 10. Alternatively, the vessel 10 can be a thin wall of a generally constant thickness that also facilitates a controlled drip free pour. The shoulder 22 transitions between the second end 16 and the body 20 in a sloped manner to allow the liquid being poured to remain in contact with the vessel 10 through the shoulder 22, as will be described in more detail below, until reaching the body 20. The shoulder 22 being sloped also allows control of the liquid when being poured out of the vessel 10 and is capable of preventing sediment from escaping the vessel 10.

The body 20 extends outwardly from the shoulder 22 and is wider than the opening 18 to expose a large surface area of liquid to the air when the vessel 10 contains liquid. The body 20 includes a series of chambers 26. The body 20 can have any number of chambers 26 greater than one with the preferred number range between three and eleven spaced symmetrically about the axis 32. It is understood that the chambers 26 may also be spaced asymmetrically about the axis 32 without varying from the scope of the disclosure.

Figure 2:
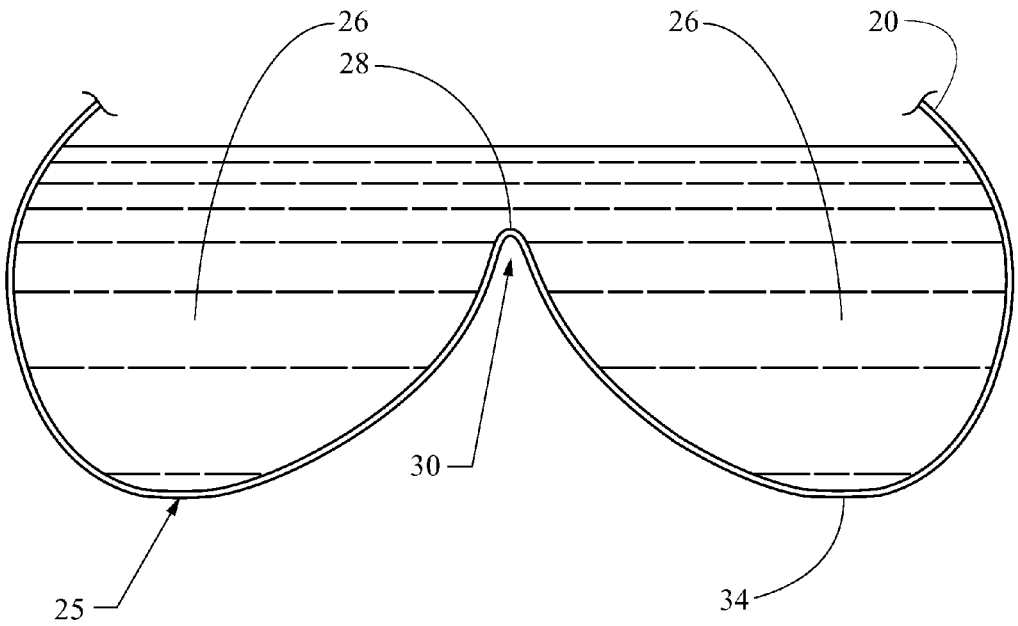
FIG. 2 schematically illustrates a cross section of the vessel cut through two adjacent chambers, in accordance with the present disclosure.

FIG. 2 schematically illustrates a cross section of the vessel 10 cut through two adjacent chambers 26 as shown on FIG. 1 at 38. Each chamber 26 includes a tripping mechanism 28, such as a wall, that defines the size of the chamber 26 and separates one chamber 26 from another chamber 26. The tripping mechanism 28 is a partial height of the body 20 and may be sloped toward an adjacent chamber 26, vertical, or rounded. It will be apparent that the tripping mechanism 28 can be any turbulence causing member, e.g., partition, divider, tube, fin, propeller, blade, airfoil, helicoidal surface, and airfoil shaped blade, regardless of any exterior features created, as will be discussed hereafter. The walls 28 create an exterior indent 30 that creates an individual chamber effect on the outside of the vessel 10 chambers 26. The chambers 26 include a contact area 34 on the bottom 25 to facilitate resting on a surface. The contact area 34 can be a point on a curve, as part of an arcuate chamber 26, and flat that creates more surface area contact between the vessel 10 and the resting surface.

Figure 3:
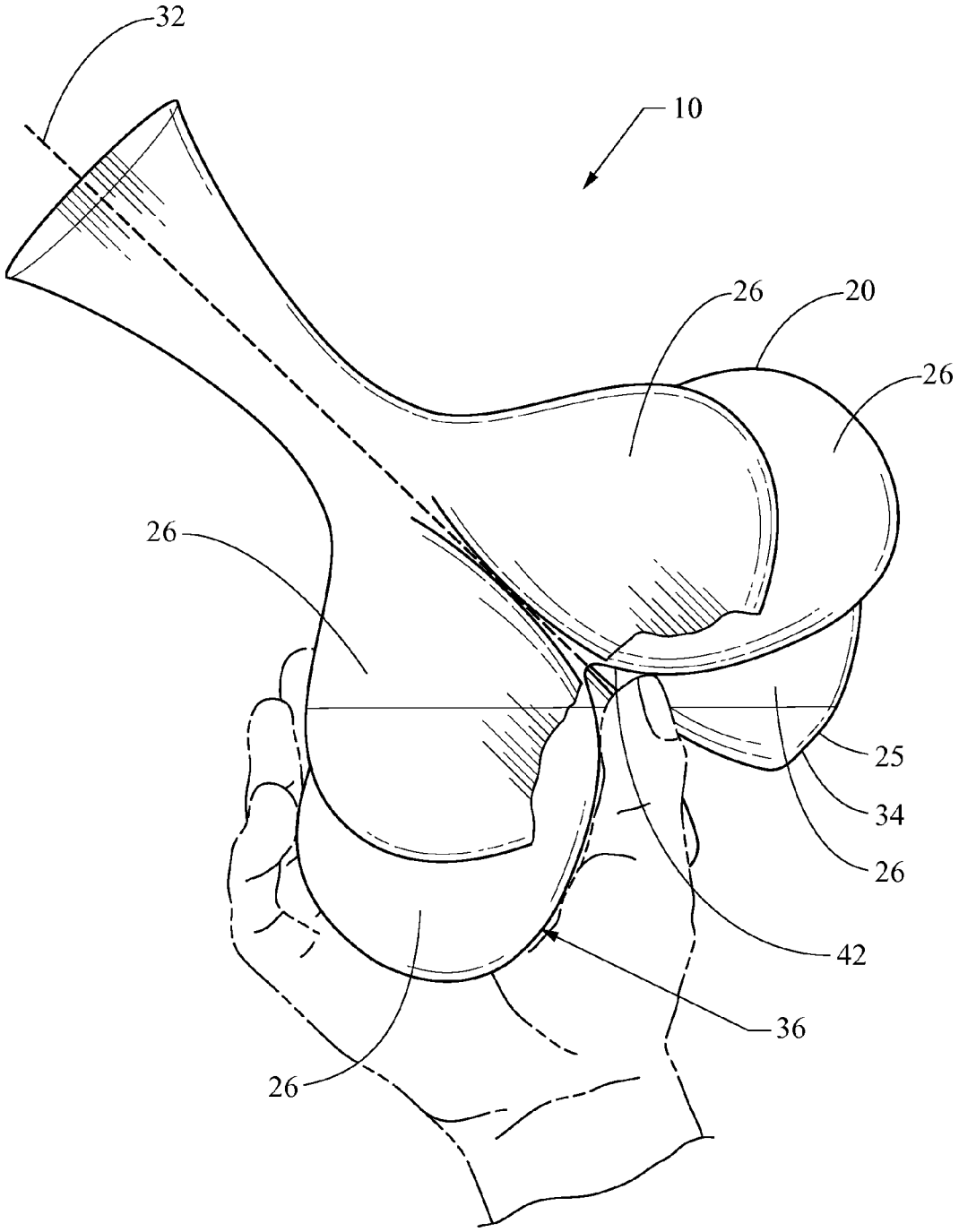
FIG. 3 schematically illustrates the vessel being held in a tipped orientation, in accordance with the present disclosure.

FIG. 3 schematically illustrates the vessel 10 being held in a tipped orientation. The body 20 includes a punt 42, e.g., a kick up, at the bottom 25 of the vessel 10 generally at the axis 32. The punt 42 extends into the body 20 of the vessel 10 further defining the individual chambers 26 and providing a relief area at the center of the bottom 25 of the vessel 10. The combination of the individual chambers 26 and the punt 42 create a hand hold 36 that is ergonomic for pouring and aerating the liquid. One of the individual chambers 26 can rest in a palm with a thumb extending into the punt 42 with fingers wrapping around the body 20 extending toward the shoulder 22. The first dorsal web, the area between the thumb and first finger, rests in the exterior indent 30 for additional stability when holding the vessel 10.

In operation, the liquid desired to be aerated is received by the opening 18 of the vessel 10. The liquid engages the neck 12 and evenly spreads around the neck, typically in the swirling manner, as the liquid is funneled to the shoulder 22. The shoulder 22 continues transferring the liquid as the liquid engages the shoulder 22 of the vessel 10 in a layer of liquid that becomes thinner as the surface area of the shoulder 22 increases over the surface area of the neck 12. The shoulder 22 directs the liquid to the complete inner surface of the body 20 and to collect in the chambers 26. The neck 12 spreads the thin layer of liquid to the shoulder 22 and into the chambers 26 to complete a passive aeration process by exposing a large surface area of liquid being poured to the air.

The passive aeration process can continue by leaving the liquid in the body 20 of the vessel 10 over time. The body 20 is wider than the neck 12 and shoulder 22 to expose a large surface area of liquid to air. Exposing the large surface area to the air allows for the natural aeration process to occur.

Figure 4:
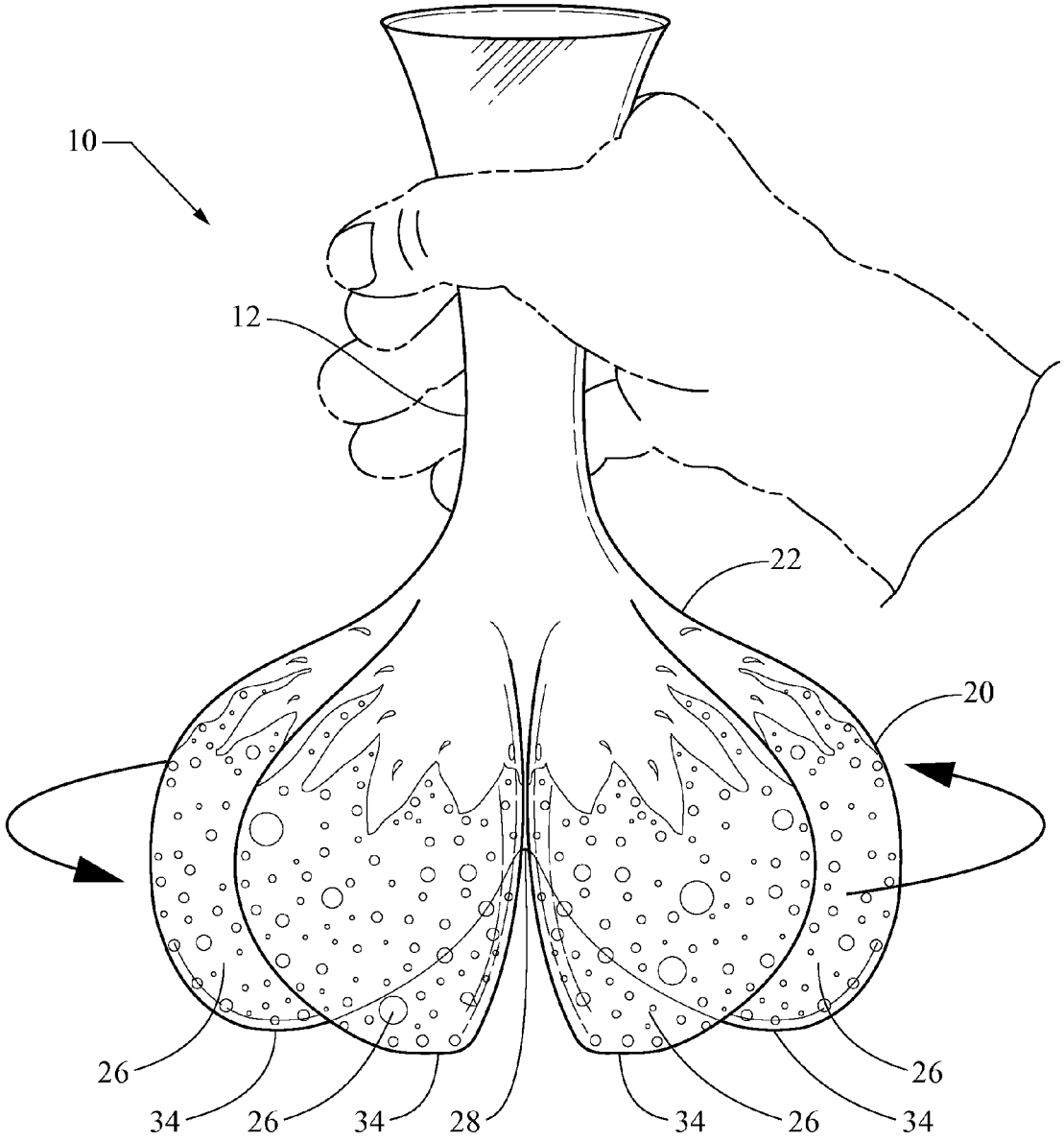
FIG. 4 schematically illustrates an active aeration process wherein the vessel is being rotated to cause relative motion between the liquid and the vessel, in accordance with the present disclosure.

FIG. 4 schematically illustrates an active aeration process wherein the vessel 10 is being rotated to cause relative motion between the liquid and the vessel 10. The active aeration process occurs once the liquid is in the chambers 26. The vessel 10 can be picked up by any number of methods including the neck 12, shoulder 22, body 20, hand hold 36 and any combination of the neck 12, shoulder 22, and body 20. The vessel 10 can then be moved in a rotational pattern to create relative motion between the liquid and the vessel 10. Since the liquid is in the chambers 26, the liquid engages the tripping mechanism 28, in this case a wall of the respective chamber 26, thereby creating a wave and tumbling effect that exposes a large amount of the liquid to air at once that quickly aerates the liquid. The combined shape of the body 20, shoulder 22, and neck 12 prevent any liquid from escaping through the opening 18. Residual air can be trapped within the liquid, in form of bubbles further enhancing the passive aeration process. The vessel 10 can be set on a hard surface by way of the contact area 34 allowing the liquid to rest thereby permitting the residual air to dissipate from the liquid. The process can be repeated to achieve the desired amount of aeration for the particular liquid.

The handhold 36 created by the combination of the punt 42, a single chamber 26, and the body 20. The chamber 26 rests in the palm of a hand with extending a thumb into the punt 42 and wrapping remaining fingers around the body 20. Holding the vessel 10 by the handhold 36, a user is able to precisely control the rate of flow of liquid being poured out of the vessel 10. The handhold 36 permits visual identification of any sediment in the vessel 10. Using the handhold 36 a user is able to trap any sediment in the shoulder 22 before the sediment can enter the neck 12 and exit the vessel 10. When the pouring is stopped, the thin opening 18 prevents drips from accumulating around the opening 18 and traveling down the outside of the vessel 10. The precise control provided by the handhold 36 enables the opening 18 to be gently rested upon a separate vessel, i.e., a drinking glass, and pulled along the opening of the separate vessel thereby further preventing any drips from accumulating around the opening 18 and traveling down the outside of the vessel 10.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A vessel for aerating a liquid, the vessel comprising:
- a neck substantially centered on a vertical axis and having a first end with an opening and a second end opposite the first end, the neck being venturi shaped;
- a shoulder extending radially outwardly and downwardly from the second end of the neck;
- a body extending from the shoulder, the body comprising:
  - at least three contiguous chambers extending from the shoulder and arranged substantially symmetrically about the vertical axis wherein:
    - the neck transitions smoothly into the shoulder;
    - an outer surface of each chamber is substantially convex;
    - each chamber includes walls that partially separates such chamber from adjacent chambers; and
    - a distance across the neck at the neck's widest cross-section is less than one-third of a distance across the body at the body's widest cross-section, the cross sections being taken substantially perpendicular to the vertical axis, the vessel further comprising: a recessed punt extending upwardly from the bottom of the vessel along the vertical axis.

2. The vessel of claim 1 wherein an interior volume within the vessel is contained predominantly within the chambers.

3. The vessel of claim 1 wherein a diameter of the neck varies along the length of the neck and an outer surface of the neck comprises a smooth arc.

4. The vessel of claim 1 wherein walls separating adjacent chambers project inwardly and upwardly.

5. The vessel of claim 1 wherein the vessel comprises at least four chambers; and each chamber includes a contact area on a bottom of the vessel to allow the vessel to rest stably on a surface.

6. The vessel of claim 1, further comprising: a punt distal from the opening of the neck and extending into the body of the vessel.

7. The vessel of claim 1 wherein the chambers define co-planar contact areas at the bottom of the chambers.

8. A vessel for aerating a liquid, the vessel comprising:

a neck substantially axially centered on a vertical axis and having a first end with an opening, a second end, and a middle section between the first and second ends;

a shoulder extending from the second end of the neck in a smooth transition;

at least three contiguous chambers extending from the shoulder and arranged substantially symmetrically about the vertical axis wherein:

each chamber forms a portion of a substantially globular shape;

a first of the chambers includes a left wall that partially separates the first chamber from a second of the chambers and a right wall that partially separates the first chamber from a third of the chambers;

a punt extends upwardly from a bottom of the vessel along the vertical axis;

the neck has an overall vertical height greater than the vertical height of the chambers;

the at least three chambers comprise a body;

the neck is venturi shaped with the first and second ends having a greater width than the middle section of the neck; and a distance across the middle section of the neck is less than one-third the distance across a widest part of the body.

9. The vessel of claim 8 wherein the walls trip a fluid in the vessel when swirled.

10. The vessel of claim 8 wherein at least three chambers include a contact on the bottom to thereby allow the vessel to rest on a surface.

11. The vessel of claim 8 wherein walls separating adjacent chambers project inwardly and upwardly.

12. The vessel of claim 8 wherein the chambers are evenly spaced about the vertical axis.

13. The vessel of claim 8 wherein the first chamber is adjacent to both the second and third chambers.

14. The vessel of claim 8 wherein the first end has an edge that is thinner than a remainder of the vessel.

* * * * *